US006431742B2

(12) United States Patent
Mori et al.

(10) Patent No.: US 6,431,742 B2
(45) **Date of Patent: *Aug. 13, 2002**

(54) CONTINUOUS MIXING APPARATUS WITH UPPER AND LOWER DISK IMPELLERS EACH HAVING SCRAPERS

(75) Inventors: Hideyuki Mori, Fukui Prefecture; Atsushi Komatsu, Chiba Prefecture; Makoto Kokubun, Chiba Prefecture; Toyohiko Yamadera, Chiba Prefecture; Mitsuo Hamada, Chiba Prefecture, all of (JP)

(73) Assignee: Dow Corning Toray Silicone Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/918,857

(22) Filed: Jul. 31, 2001

(30) Foreign Application Priority Data

Jul. 31, 2000 (JP) ..... 2000-232146

(51) Int. Cl.[7] ..... B01F 7/26; B01F 15/02

(52) U.S. Cl. ..... 366/171.1; 366/172.1; 366/172.2; 366/294; 366/303; 366/312; 366/317

(58) Field of Search ..... 366/168.1, 171.1, 366/172.1, 172.2, 174.1, 178.1–178.3, 181.4, 303, 304, 306, 307, 309, 312, 293–296, 317; 241/46.017, 46.08

(56) References Cited

U.S. PATENT DOCUMENTS 3,308,171 A * 3/1967 Oikawa
3,929,320 A * 12/1975 Haller
3,998,433 A * 12/1976 Iwako
4,096,587 A * 6/1978 Haller
4,175,873 A * 11/1979 Iwako et al.
4,691,867 A 9/1987 Iwako etal.
5,599,102 A 2/1997 Hamada et al.
6,019,498 A * 2/2000 Hamada et al.
6,218,466 B1 * 4/2001 Hamada et al.

FOREIGN PATENT DOCUMENTS

JP 60-209233 * 10/1985
JP 60-209234 * 10/1985
JP 2000-449 1/2000

* cited by examiner

*Primary Examiner*—Charles E. Cooley
(74) *Attorney, Agent, or Firm*—Jim L. De Cesare

(57) ABSTRACT

A continous mixing apparatus has an upper rotary disk and a lower rotary disk able to rotate independently of one another. A plurality of scrapers are attached to the upper and lower sides of the upper and lower rotary disks. Scrapers on the lower side of the lower rotary disk have a notch enabling the scrapers to pass over a lower ring plate in the mixer. Material to be mixed is supplied to an upper portion of the mixer, and the product is discharged from a lower portion of the mixer. The device is constructed to enable any subsequently replenished liquids to not rise to the top of the mixing apparatus. The device produces a mixture that is uniform, highly stable, and that has a small particle size or a low viscosity which can be manufactured quickly.

4 Claims, 2 Drawing Sheets

CONTINUOUS MIXING APPARATUS WITH UPPER AND LOWER DISK IMPELLERS EACH HAVING SCRAPERS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention is directed to an apparatus for continuously mixing different types of material. More particularly, it is directed to a mixing apparatus for continuously manufacturing a liquid mixture, or a mixture containing a large amount of liquid, by continuously supplying different types of materials such as liquids or powders and liquids, into a casing. These materials are mixed by rotation of an upper rotary disk and a lower rotary disk. The disks rotate independently of each other and continuously create a crude mixture. The casing can be continuously replenished with liquid and mixed with the crude mixture.

BACKGROUND OF THE INVENTION

Japanese Patent Application Publication No. 2000-449A discloses a method in which a liquid organopolysiloxane, an emulsifier, and water, are supplied to a mixing chamber, and a grease in the form of an organopolysiloxane aqueous liquid is manufactured by rotation of a rotary disk equipped with a scraper. However, because emulsification is performed in a dilute state from the outset it is a problem in that the particle size of the emulsion is large and the emulsion is unstable.

U.S. Pat. No. 4,691,867 (Sep. 8, 1987) discloses a continuous mixing apparatus for creating a slurry from a micropowder and a powder such as oil coke. In the '867 patent, a powder and a liquid are introduced into an upper mixing chamber, and the powder is wetted by the liquid via rotation of an upper rotary mixing disk, to create a wet crude mixture. The crude mixture is transferred to a lower mixing chamber, and the components are completely mixed into a slurry by rotation of a lower rotary mixing disk. However, the crude mixture pulsates in the course of being transferred to the lower mixing chamber, causing backflow of the mixture in the lower mixing chamber and into the upper mixing chamber. Since all of the powder and liquid are introduced into the upper mixing chamber, the powder and liquid are mixed in a dilute state from the outset, and this results in poor powder dispersibility.

U.S. Pat. No. 5,599,102 (Feb. 4 , 1997) discloses a mixing apparatus for continuously manufacturing a low viscosity mixture by (i) introducing a powder and a liquid into a mixing chamber, (ii) preparing a crude mixture of powder and liquid by rotation of a rotary disk, (iii) replenishing the liquid from under the rotary disk, and (iv) mixing the liquid with the crude mixture. However, subsequently replenished liquid rises in the vicinity of the rotary disk, and when an emulsion is prepared, particle size increases and emulsions become unstable. When mixtures of a powder and liquid are prepared, viscosity of the mixture is too high.

BRIEF SUMMARY OF THE INVENTION

Therefore, it is an object of the invention to provide a continuous mixing apparatus in which subsequently replenished liquid does not rise to the top of the mixing apparatus, and a mixture that is uniform, highly stable, and that has either a small particle size or a lower viscosity, can be quickly manufactured.

These and other features of the invention will become apparent from a consideration of the detailed description.

BRIEF DESCRIPTION OF THE SEVERAL VIEWS OF THE DRAWING

In FIGS. 1 and 2, similar parts are identified with the same numerals and letters. In the figures, A denotes one embodiment of continuous mixing apparatus, B denotes another embodiment of continuous mixing apparatus, 1 is the casing, 1*a* is the cylinder, 1*b* is the lid, 1*c* is the inverted cone, 2*a* is the uppermost mixing chamber, 2*b* is the upper mixing chamber, 2*c* is the middle mixing chamber, 2*d* is the lower mixing chamber, 3*a* is the upper rotary disk, 3*b* is the lower rotary disk, 4*a* is the rotary shaft, 4*b* is the rotary shaft, 5*a* is the pulley, 5*b* is the pulley, 6 is the bearing, 7*a* is the upper scraper, 7*b* is the lateral side scraper, 7*c* is the lower scraper, 7*d* is the upper scraper, 7*e* is the lateral side scraper, 7*f* is the lower scraper, 7*g* is the notch, 8*a* is the upper ring plate, 8*b* is the lower ring plate, 9*a* is the material supply port, 9*a* is the material supply pipe, 9*b* is the material supply pipe, 9*c* is the liquid supply pipe, 9*d* is the liquid supply pipe, and 10 is the discharge port.

DETAILED DESCRIPTION OF THE INVENTION

Figure 1:
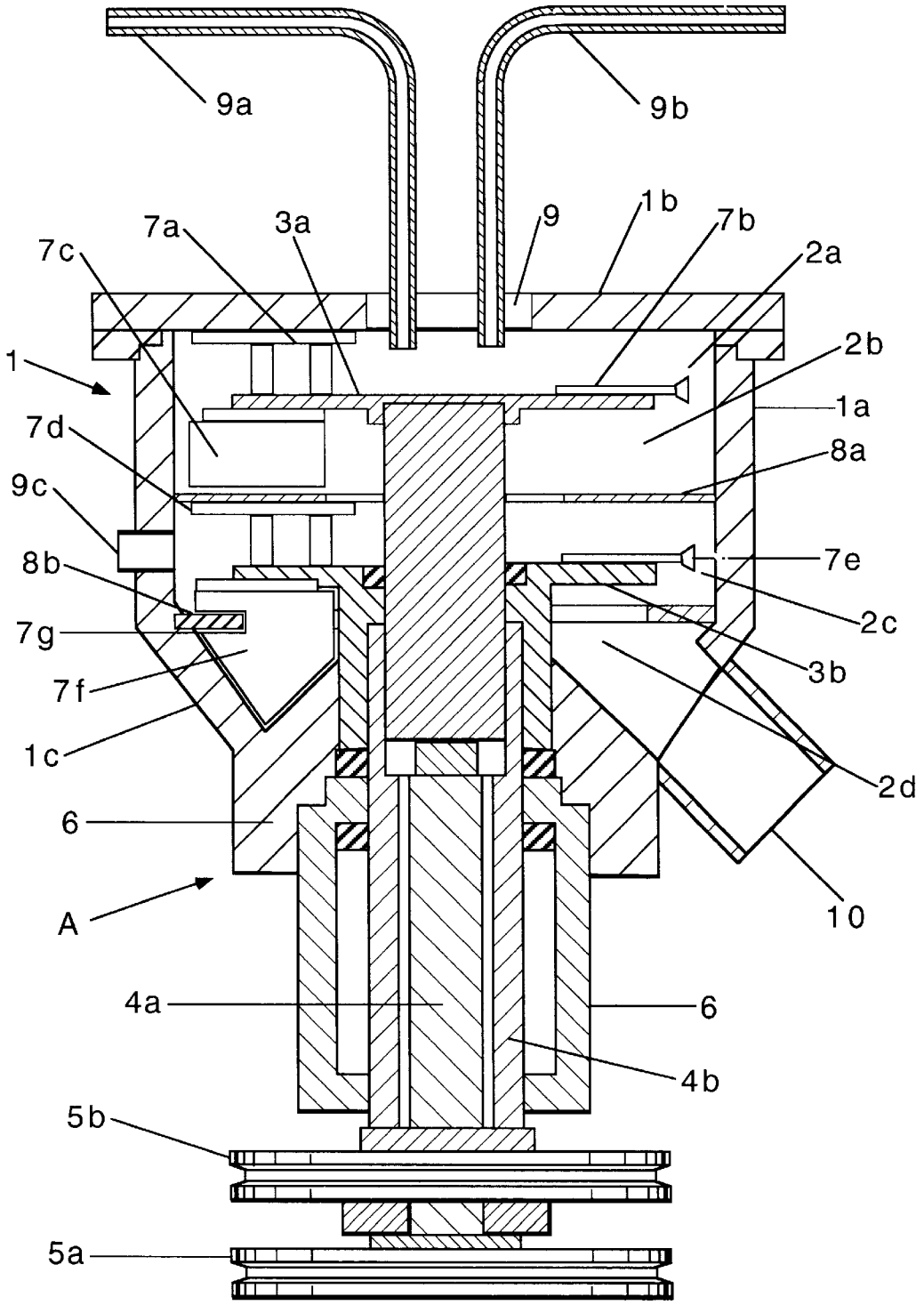
FIG. 1 is a pictorial representation and cross sectional view of continuous mixing apparatus A according to one embodiment of the invention.
Figure 2:
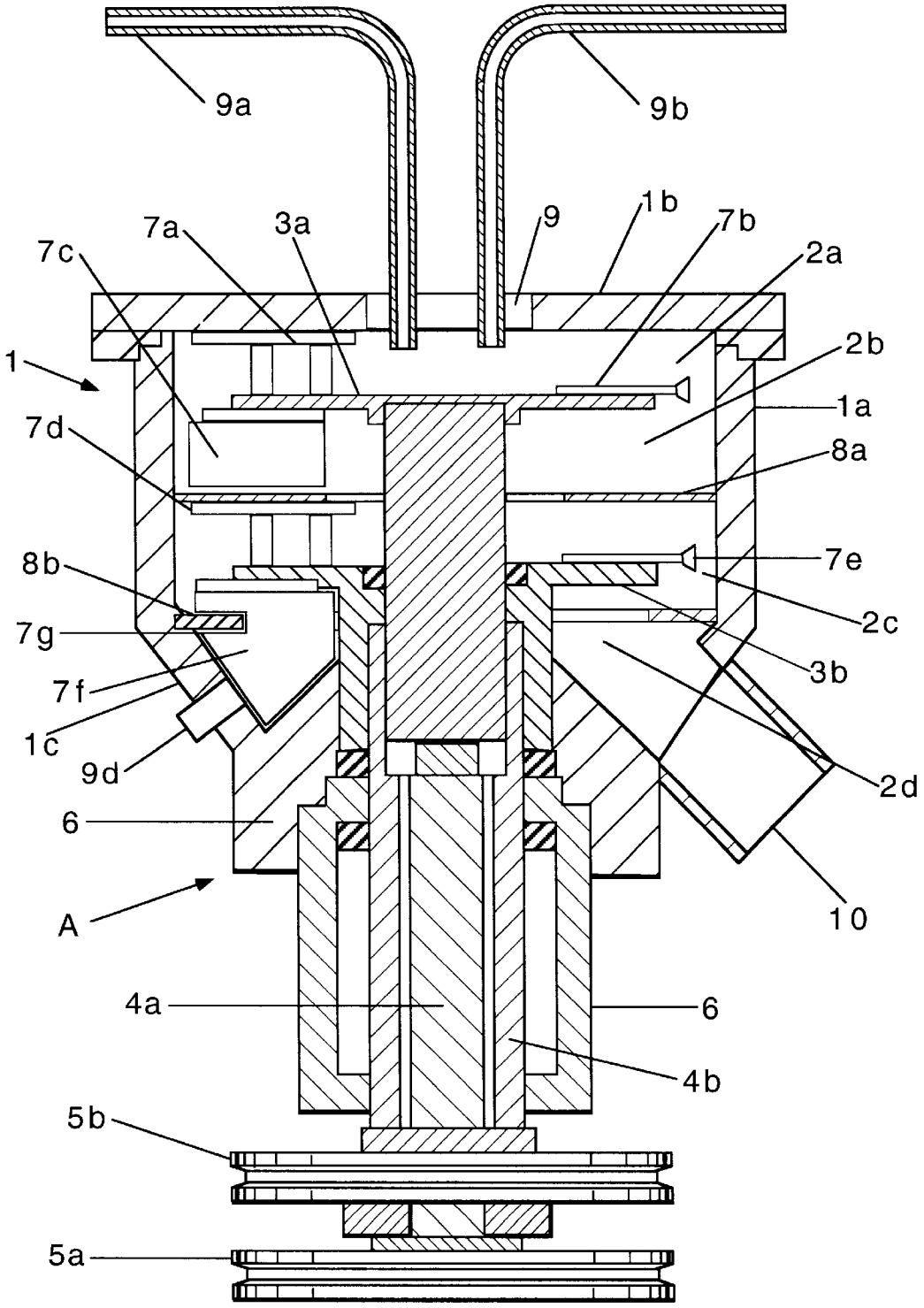
FIG. 2 is a pictorial representation and cross sectional view of continuous mixing apparatus in another embodiment of the invention. The apparatus in FIG. 2 is the same as the apparatus in FIG. 1 except that in FIG. 2 there is no liquid supply pipe 9*c*, and in FIG. 2 a liquid supply pipe 9*d* for replenishing liquid in the lower mixing chamber 2*d*, passes through the outer sloped surface of inverted cone 1*c*.

The continuous mixing apparatus contains an upper rotary disk and a lower rotary disk that rotate independently of each other, and are disposed in a mixing chamber within a casing. Scrapers are attached to the upper and lower sides of the upper rotary disk, and to the upper and lower sides of the lower rotary disk. An upper ring plate extends from the inner walls of the casing in a non-contact state between the lower scraper of the upper rotary disk and the upper scraper of the lower rotary disk. A lower ring plate extends from the inner walls of the lower part of the casing, and intersects in a non-contact state with a notch of the lower scraper of the lower rotary disk.

The mixing chamber inside the casing is divided by the upper rotary disk, the upper ring plate, and the lower ring plate, into an uppermost mixing chamber, an upper mixing chamber, a middle mixing chamber, and a lower mixing chamber. A material supply port for supplying different types of material to the uppermost mixing chamber is located in the upper portion of the casing. A liquid supply port for replenishing liquid in the middle mixing chamber or in the lower mixing chamber, is located in the side wall of the casing. A discharge port for discharging the mixture from the lower mixing chamber is located at the bottom of the casing.

In the continuous mixing apparatus, different types of material such as a powder and a liquid, different types of powders, or different types of liquids, supplied to the uppermost mixing chamber, (i) move radially outward over the rotating upper rotary disk and adhere to the ceiling of the mixing chamber, (ii) are scraped off by the upper scraper, and (iii) are subjected to shearing action. Scraped off material falls onto the upper rotary disk and continues to move radially outward over the rotating upper rotary disk. The material is thereby subjected to a first kneading action and becomes a crude mixture. The crude mixture moves through the space between the edge of the upper rotary disk and the inner wall of the casing, into the upper mixing chamber, and is scraped off by the lower scraper of the upper rotary disk, and thereby subjected to shearing action. As a result, the material is subjected to a second kneading action and forms a more uniform crude mixture.

The crude mixture moves through the space between the upper ring plate and the rotary shaft into the middle mixing chamber, where it moves radially outward over the lower rotary disk and adheres to the lower side of the upper ring plate. It is scraped off by the upper scraper of the lower rotary disk, and is subjected to shearing action. Scraped off crude mixture moves onto the lower rotary disk and once again moves radially outward over the lower rotary disk. The material is subjected to a third kneading action and forms an even more uniform crude mixture. The crude mixture continues to move through the space between the edge of the ring plate and the surface of the bearing into the lower mixing chamber, where any mixture adhering to the sloped surface at the bottom of the casing and the lower ring plate is scraped off by the lower scraper of the lower rotary disk, and subjected to shearing action.

As a result, the material is subjected to four kneading actions. During this time, the crude mixture is diluted by the addition of liquid supplied from a liquid supply pipe located in the side wall of the casing in the middle mixing chamber in one embodiment, or in the side wall of the casting in the lower mixing chamber in another embodiment. After having been kneaded four times and diluted with replenishing liquid, the mixture is discharged from the apparatus from a discharge port located at the bottom of the casing.

The material being mixed in the apparatus is a fluid, typically a mixture of a liquid and a powder. The powder need not be a single material but it can be a mixture of different types of powder. Some examples of powders include starch, wheat, pigments, metal powders, powdered filler, powdered polymers, and rubber powders. Some examples of powdered fillers include hydrophobically treated fumed silica, wet silica, diatomaceous earth powder, quartz powder, calcium carbonate powder, magnesium oxide powder, alumina powder, and carbon black. Some examples of powdered polymers include silicone resin powders and various types of thermoplastic resin powder.

Similarly, the liquid need not be pure but can be a liquid such as a solution. Some examples of liquids include aqueous solutions, malt syrup, edible oils, organic solvents, nonaqueous solutions, liquid compounds, and liquid polymers. Some examples of liquid compounds include emulsifiers, surfactants, thickeners, plasticizers, and stabilizers. Some examples of liquid polymers include liquid silicone polymers, liquid polybutadiene, liquid polybutene, liquid polyurethane, and liquid epoxy resins.

The continuous mixing apparatus is especially useful in the continuous mixing of different types of materials such as a powder and a liquid, different types of powders, or different types of liquids. The term different types of powder is intended to include, for example, powders of the same type of material but with particles of different shapes or average size. The term different types of liquid is intended to include, for example, liquids of the same material but of different viscosity. Some examples include diorganopolysiloxanes in the form of raw rubber, low viscosity diorganopolysiloxanes, and solutions thereof with different concentration.

Some examples of replenishing liquids that may be used according to this invention include liquids which are the same as the liquid used in the crude mixture, or the replenishing liquid can be different.

The mixture discharged from the continuous mixing apparatus can be in many different forms depending on the type of materials being mixed and the blend ratios thereof. Some examples include compounds, slurries, pastes, grease, emulsions, dispersions, and solutions. The continuous mixing apparatus is particularly useful for manufacture of (i) emulsions using an emulsifier to emulsify a liquid such as a liquid polymer in water, or for manufacture of (ii) compounds, slurries, or pastes, by mixing liquids such as liquid polymers with powders such as reinforcing fillers.

With reference now to the drawing, FIG. 1 represents one embodiment of continuous if mixing apparatus A according to the invention. In FIG. 1, an upper rotary disk 3*a* and a lower rotary disk 3*b* rotate independently of each other, and are disposed horizontally in mixing chambers 2*a*, 2*b*, 2*c*, and 2*d*, within casing 1. The center of the upper rotary disk 3*a* is fixed to the upper end of rotary shaft 4*a*, and the center of the lower rotary disk 3*b* is fixed to the upper end of rotary shaft 4*b*. Rotary shaft 4*a* is located in rotary shaft 4*b* but shafts 4*a* and 4*b* rotate independently of one another. Pulley 5*a* is attached to the base of rotary shaft 4*a*, and rotary shaft 4*a* is rotated by transmission of rotation by a first motor which is not shown.

The peripheral velocity of upper rotary disk 3*a* is preferably 3–240 m/sec. Pulley 5*b* is fish attached to the base of rotary shaft 4*b*, and rotary shaft 4*b* is rotated by transmission of rotation by a second motor which is not shown. The peripheral velocity of lower rotary disk 3*b* is preferably 3–60 m/sec. As long as the peripheral velocity of upper rotary disk 3*a* is higher than the peripheral velocity of lower rotary disk 3*b*, replenishing liquid coming from the liquid supply pipe will not rise and infiltrate the uppermost mixing chamber and the upper mixing chamber. It is preferred to maintain the peripheral velocity of upper rotary disk 3*a* higher than the peripheral velocity of lower rotary disk 3*b*. Therefore, the ratio between the peripheral velocity of upper rotary disk 3*a* and the peripheral velocity of lower rotary disk 3*b* is preferably 4:1, to slightly more than 1:1, excluding the ratio 1.0:1.0.

Rotary shaft 4*b* is supported by bearing 6. Scraper 7*a* is attached to the upper side of upper rotary disk 3*a*, scraper 7*b* is attached to the lateral side of upper rotary disk 3*a*, and scraper 7*c* is attached to the lower side of upper rotary disk 3*a*. Scraper 7*d* is attached to the upper side of lower rotary disk 3*b*, scraper 7*e* is attached to the lateral side of lower rotary disk 3*b*, and scraper 7*f* is attached to the lower side of lower rotary disk 3*b*. Lateral side scrapers 7*b* and 7*e* are not essential to operation of the apparatus and can be omitted, if desired. While only a single scraper can be employed for each rotary disk, two or more scrapers are preferably employed for each rotary disk. When two or more scrapers are used, however, they should be positioned equiangularly of the centerline of shafts 4*a* and 4*b*.

Scraper 7*f* attached to the lower side of lower rotary disk 3*b* is in the form of a sheet or lattice, and extends radially and vertically. Horizontal notch 7*g* is cut in lower scraper 7*f* and extends inwardly towards rotary shafts 4*a* and 4*b*. Scraper 7*f* is capable of relative movement with respect to lower ring plate 8*b*.

Upper ring plate 8*a* extends from the inner wall of cylinder 1*a* of casing 1 between lower scraper 7*c* of upper rotary disk 3*a* and upper scraper 7*d* of lower rotary disk 3*b*, and there is a space between rotary shaft 4*a* and the edge of upper ring plate 8*a* through which the mixture may pass. Lower ring plate 8*b* extends from the inner wall of inverted cone 1*c* of casing 1, and intersects in a non-contact state with notch 7*g* of lower scraper 7*f* of lower rotary disk 3*b*. Lower rotary disk 3*b* rotates in this mode.

The mixing chamber of casing 1 is divided by upper rotary disk 3*a*, upper ring plate 8*a*, and lower ring plate 8*b*, into uppermost mixing chamber 2*a*, upper mixing chamber 2*b*, middle mixing chamber 2*c*, and lower mixing chamber 2*d*. Material supply ports 9*a* and 9*b* for supplying different types of material into uppermost mixing chamber 2*a*, are provided in the center of lid 1*b* of casing 1. The lower end of material supply pipes 9*a* and 9*b* are located in uppermost mixing chamber 2*a*.

Liquid supply pipe 9*c* for replenishing liquid in middle mixing chamber 2*c* passes through cylinder 1*a* of casing 1. Inverted cone portion 1*c* is contiguous with the bottom portion of cylinder 1*a*. Bearing 6 extends upwardly from the center of inverted cone 1*c* forming a depression that is annular and V-shaped in cross section. Discharge port 10 for discharging the final mixture from lower mixing chamber 2*d* is located in inverted cone 1*c*, and forms the bottom portion of casing 1.

EXAMPLE

The following example is set forth in order to illustrate the invention in more detail.

Application Example

Using continuous mixing apparatus A as depicted in FIG. 1, a dimethylpolysiloxane fluid terminated at each end of its chain with trimethylsiloxy groups, and having a viscosity of 3000 mPa s, was continuously supplied from material supply pipe 9*a* to uppermost mixing chamber 2*a* by a metering pump (not shown) while upper rotary disk 3*a* and lower rotary disk 3*b* were rotating. The peripheral velocity of upper rotary disk 3*a* was 24 m/sec, and the peripheral velocity of lower rotary disk 3*b* was 12 m/sec. An aqueous solution of cetyltrimethyl ammonium chloride in which the weight ratio of cetyltrimethyl ammonium chloride and water was 0.6:1.4, was continuously supplied from material supply pipe 9*b* to uppermost mixing chamber 2*a* by a metering pump (not shown). The weight ratio of dimethylpolysiloxane and aqueous solution of cetyltrimethyl ammonium chloride was 100:2.0. An emulsion in the form of a high viscosity grease was prepared as a result. At the same time, water was continuously supplied from liquid supply pipe 9*c* to middle mixing chamber 2*c* by another metering pump (not shown). An oil-in-water dimethylpolysiloxane emulsion was continuously discharged from discharge port 10. The particle size of dimethylpolysiloxane in the oil-in-water emulsion was approximately 0.4 $\mu$m, and the oil-in-water emulsion remained stable when stored for extended periods.

It should be apparent from the example, that different types of fluid materials can be mixed using the continuous mixing apparatus of the invention, and that any subsequently introduced replenished liquid does not rise to the top of the apparatus. Mixtures can be manufactured quickly, and are uniform, highly stable, and have small particle size or low viscosity.

Other variations may be made in compounds, compositions, and methods described herein without departing from the essential features of the invention. The embodiments of the invention specifically illustrated herein are exemplary only and not intended as limitations on their scope except as defined in the appended claims.

What is claimed is:

1. A continuous mixing apparatus comprising a casing; an upper rotary disk and a lower rotary disk capable of being rotated independently, disposed in a mixing chamber within the casing; a plurality of scrapers attached to upper and lower sides of upper rotary disk and to the upper and lower sides of lower rotary disk; an upper ring plate extending from the inner wall of the casing between a lower one of the scrapers of the upper rotary disk and an upper scraper of the lower rotary disk; a lower ring plate extending from the inner wall of the casing in a lower portion thereof, the scrapers on the lower side of the lower rotary disk having a notch enabling the scrapers on the lower side of the lower rotary disk to pass over the lower ring plate; the mixing chamber inside the casing being divided by the upper rotary disk, the upper ring plate, and the lower ring plate, into an uppermost mixing chamber, an upper mixing chamber, a middle mixing chamber, and a lower mixing chamber, respectively; material supply ports in the upper portion of the casing for supplying different types of materials to the uppermost mixing chamber; a liquid supply port for feeding replenishing liquid, the liquid supply port extending through the side wall of the casing to the middle mixing chamber or the lower mixing chamber; and a discharge port in the lower mixing chamber for discharging the mixture of materials.

2. The continuous mixing apparatus according to claim 1 wherein the ratio of the rotational speed of the upper rotary disk and the rotational speed of the lower rotary disk is 4:1 to more than 1.0 to 1.0.

3. The continuous mixing apparatus according to claim 1 wherein the different types of material are liquids.

4. The continuous mixing apparatus according to claim 3 wherein the different types of liquids are a silicone oil and an emulsifier; wherein the replenishing liquid is water; and wherein the mixture of materials is an aqueous emulsion containing the silicone oil.

* * * * *